US006379169B1

(12) United States Patent
Corona

(10) Patent No.: US 6,379,169 B1
(45) Date of Patent: Apr. 30, 2002

(54) ELECTRICAL PLUG HOUSING

(75) Inventor: Sergio Corona, Upland, CA (US)

(73) Assignee: DSM & T Co. Inc., Fontana, CA (US)

( * ) Notice: Subject to any disclaimer, the term of this patent is extended or adjusted under 35 U.S.C. 154(b) by 0 days.

(21) Appl. No.: 09/633,583

(22) Filed: Aug. 7, 2000

(51) Int. Cl.[7] ..... H01R 13/52
(52) U.S. Cl. ..... 439/271; 439/369
(58) Field of Search ..... 439/271, 923, 439/350, 352, 180, 369, 370, 371

(56) References Cited

U.S. PATENT DOCUMENTS

| | | | | | |
|---|---|---|---|---|---|
| 360,871 | A | | 4/1887 | Wilson | D13/133 |
| 360,872 | A | | 7/1887 | Wilson | D13/133 |
| 4,637,674 | A | * | 1/1987 | Kobler | 339/94 |
| 5,120,237 | A | * | 6/1992 | Fussell | 439/282 |
| 5,401,181 | A | | 3/1995 | Wilson | 439/281 |
| 5,957,715 | A | * | 9/1999 | Fukuda | 439/271 |
| 6,080,004 | A | * | 6/2000 | Kovacilk et al. | 439/369 |

* cited by examiner

*Primary Examiner*—P. Austin Bradley
*Assistant Examiner*—Alexander Gilman
(74) *Attorney, Agent, or Firm*—Collard & Roe, P.C.

(57) ABSTRACT

An electrical plug connector having fluid sealing between mated parts, and is provided with a locking mechanism. The mated parts consist of a male connector part having at least one contact pin extending therefrom, and a female connector part that contains at least one contact pin receptacle adapted to receive the male contact pins. The fluid sealing is accomplished by a bead extending circumferentially around the periphery of the female mating area, which fits into a groove provided on the periphery of the male part. The electrical plug locking mechanism includes a cylindrically shaped member extending from the periphery of the male part, and a latch attached to the periphery of the female connector part. This latch is adapted to receive the cylindrically shaped member therethrough, which locks the male and female connector parts together.

16 Claims, 2 Drawing Sheets

ELECTRICAL PLUG HOUSING

BACKGROUND OF THE INVENTION

1. Field of the Invention

The present invention relates to an electrical plug connector housing with fluid sealing and a locking mechanism.

2. The Prior Art

Connectors are known for coupling and uncoupling electrical cables. Connectors for outdoor applications frequently require a separate rubber or plastic gasket to obtain a moisture-proof seal. It would be advantageous to combine the gasket with the connector parts to reduce the number of parts and simplify the mating of the connector parts. The reduction of the number of parts makes it possible to produce the connector less expensively and makes mating easier.

SUMMARY OF THE INVENTION

The present invention provides an electrical plug connector having fluid sealing between mated parts, and is provided with a locking mechanism. The mated parts consist of a male connector part having at least one contact pin extending therefrom, and a female connector part that contains at least one contact pin receptacle adapted to receive the male contact pins. The fluid sealing is accomplished by a bead extending circumferentially around the periphery of the female mating area, which fits into a groove provided on the periphery of the male part. The electrical plug locking mechanism includes a cylindrically shaped member extending from the periphery of the male part, and a latch attached to the periphery of the female connector part. This latch is adapted to receive the cylindrically shaped member therethrough, which locks the male and female connector parts together.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
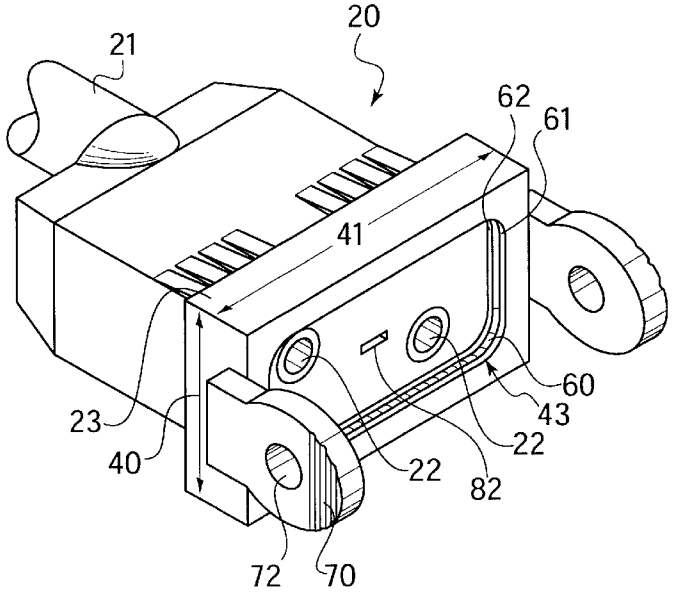
FIG. 1 shows a front view of the female connector part according to the invention.

Referring now to the drawings and, in particular, in FIG. 1 there is shown a female connector part 20 having contact receptacles 22 located within a molded housing 23 and electrically coupled to separate conductors of wire 21. Contact receptacles 22 are arranged to receive contact pins 12 of male connector part 10 (shown in FIG. 2).

Female connector part 20 further comprises a latch 70 on two opposite sides of housing 23. Latch 70 contains an aperture 72 into which cylindrical shaped flange 100 (shown in FIG. 2) fits to lock female connector part 20 and male connector part 10 together.

Figure 2:
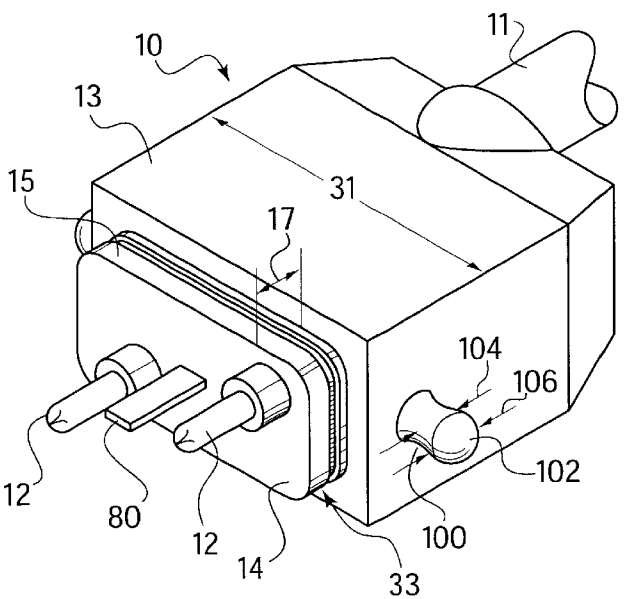
FIG. 2 shows a front view of the male connector part.

FIG. 2 shows a male connector part 10 which includes a molded housing 13 and a rectangular body 14 from which contact pins 12 extend. Rectangular body 14 consists of four outer peripheral surfaces 15 which together form a male mating area. The male mating area has a height 17 which is 0.200 inches, for example.

Figure 6:
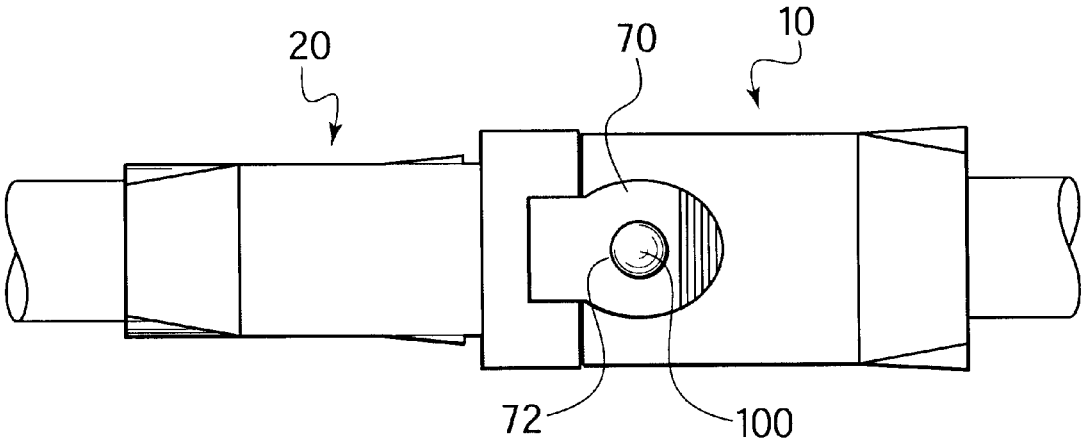
FIG. 6 shows the female and male connector parts attached to each other.

Cylindrical shaped flanges 100 extend from two opposite sides of molded housing 13. Cylindrical shaped flange 100 has an hourglass shape and comprises a dome-shaped end 102. Cylindrical shaped flange 100 is preferably 0.225 mm in length, with 0.075 mm of this length being the dome-shaped end. Cylindrical shaped flange 100 contains a middle diameter 104, which is preferably 0.16 mm and an end diameter 106, which is preferably 0.187 mm. The diameter of aperture 72 is preferably 0.162 mm, which is larger than middle diameter 104 and smaller than end diameter 106 of cylindrical flange 100. Cylindrical shaped flange 100 is made of a resilient rubber so that it can be squeezed through latch 70 and then resume its initial shape to firmly lock the two connectors together. This flange is used to lock male connector part 10 to female connecter part 20, as shown in FIG. 6.

Housing 13 has an overall height 30 and an overall width 31 which are 0.720 inches and 1.250 inches, respectively, for example. Rectangular body 14 includes corners 33 that have a 0.125 radius of curvature, for example.

Figure 3:
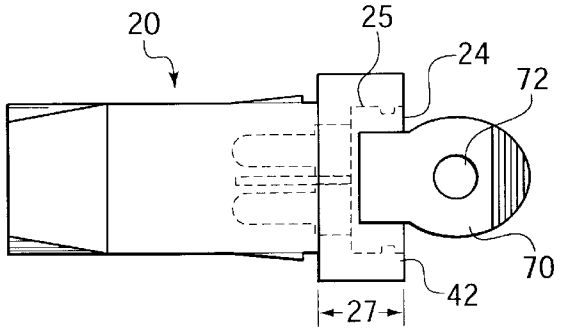
FIG. 3 shows a side view of the female connector part with the other side being the same.
Figure 4:
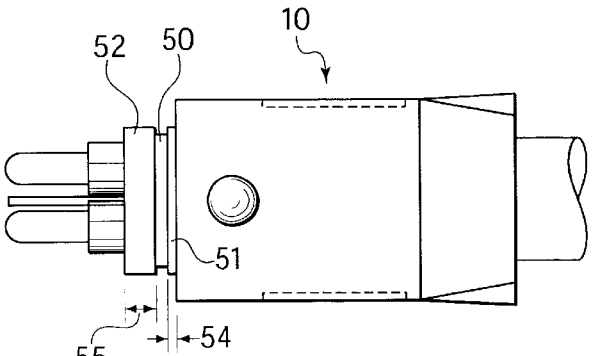
FIG. 4 shows a side view of the male connector part with the other side being the same.

As can be seen in FIGS. 1 and 3, female connector part 20 has a height 40 and a width 41 that is approximately equal to height 30 and length 31 of male connector part 10. Female connector part 20 includes a lip 42 defining rectangular opening 24. Lip 42 has a width of 0.100 inches, for example. Lip 42 includes four interior facing corners 43 having a radius of curvature of 0.125 inches.

Rectangular opening 24 contains inner peripheral surfaces 25. The inner peripheral surfaces collectively define a female mating area. This female mating area has a depth 27, which is, for example, 0.200 inches, which is equal to height 17 of male connector part 10.

FIGS. 1–4 show the sealing mechanism of the electrical plug housing. A groove 50 is located between a first section 51 and a second section 52. Groove 50 has a width of 0.040 inches, for example. First section 51 has a width 54 of 0.115 inches and second section 52 has a width 55 of 0.045 inches, for example. Groove depth 56 is 0.020 inches, for example.

A bead 60 having a width of 0.030 inches, for example, is located between a first section 61 having a width of 0.050 inches, for example, and a second section 62 having a width of 0.120 inches, for example. The bead height is 0.020 inches, for example.

The female mating area is made of a resilient rubber or plastic material. Initially, first section 61 comes into contact with second section 52. Thereafter, bead 60, which will fit snugly within groove 50, passes over second section 52. The female mating area expands slightly and when sections 61 and 62 come into overlapping relationship with sections 51 and 52, bead 60 snaps into groove 50 under the restoring force of the female mating area. The height of bead 60 and the depth of groove 50 are approximately equal, so that a water and vapor seal is achieved between contact pins 12, receptacles 22, and the external environment.

Figure 5:
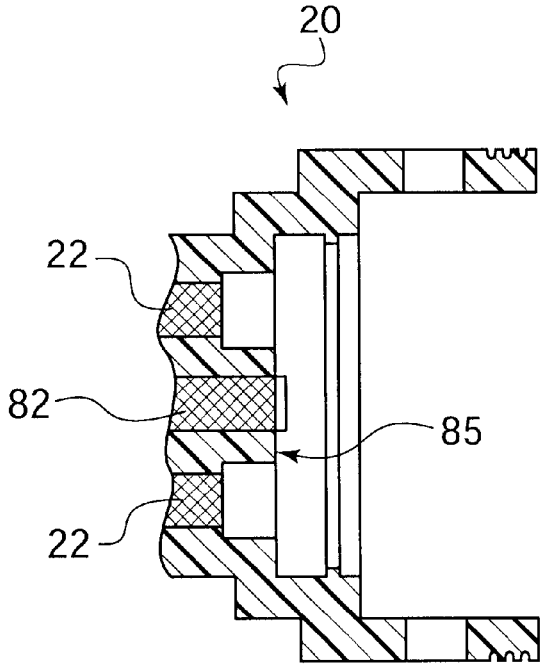
FIG. 5 shows a cut-away view of the female connector part.

As can be seen in FIG. 5, there is a cut away view of female connector part 20 showing contact pin receptacles 22. Grounding pin receptacle 82 begins at inner peripheral surface 85 allowing grounding pin 80 to complete contact before contact pins 22. This provides a grounded connection before activation and remains grounded while the contact pins are being removed.

The small dimensions of connector parts 10 and 20 allow them to be used in a variety of applications where larger connectors could not fit. For example, in the spa industry, there is a need for a waterproof or splashproof connector that is small enough to be located in narrow passageways where larger conventional connectors cannot fit.

It should be noted that male connector part 10 and female connector part 20 can be equipped with a variety of configurations of contact pins and receptacles. For example, two or three contact pins could be attached to male connector part 10. The negative or ground contact pin is generally a flat contact, with the hot contact pins having a generally circular cross section. A set of corresponding receptacles can then be provided on female connector part 20.

Accordingly, while only one embodiment of the present invention ha been shown and described, it is obvious that many changes and modifications may be made thereunto without departing from the spirit and scope of the invention.

What is claimed is:

1. A connector having a fluid sealing between mated parts comprising:

a) a male connector part having a body containing at least one contact pin, an outer rectangular peripheral surface of said rectangular body forming a male mating area;

b) a female connector part containing at least one contact pin receptacle having a rectangular opening adapted to receive said male connector part within said opening, an inner rectangular peripheral surface of said female connector part defining said rectangular opening and forming a female mating area for said contact pins;

c) a bead molded into and extending circumferentially around the rectangular periphery of one of said male and female mating areas, the other of said male and female mating areas having a groove extending circumferentially around the rectangular periphery adapted to receive said bead to create a fluid seal between said male and female connectors;

d) at least two cylindrically shaped members extending from opposite peripheral sides of said male connector part, each of said at least two cylindrically shaped members having a dome-shaped end and an hourglass shape having a middle diameter and an end outer diameter; and e) at least two latches corresponding to said at least two cylindrically shaped members and attached to the rectangular periphery of said female connector part, each of said latches adapted to receive a corresponding one of said at least two cylindrically shaped members therethrough, locking said male and female connector parts together, each of said latches containing an opening larger than said middle diameter and smaller than said end outer diameter of said cylindrically shaped member, said cylindrically shaped member being made of a malleable material allowing said dome-shaped end to press through said latch opening.

2. The connector according to claim 1, wherein said male connector part further comprises a grounding contact pin.

3. The connector according to claim 2, wherein said female connector part further comprises a grounding pin receptacle disposed at the peripheral surface of so that said grounding contact pin is connected before said at least one contact pin.

4. The connector according to claim 1, wherein said male and female connector parts are movable along a mating axis to connect and disconnect said at least one contact pin and said at least one contact receptacle, said male and female mating areas being oriented parallel to the mating axis.

5. The connector according to claim 4, wherein said bead has a bead height measured transverse to said mating axis, and the groove has a groove depth which is approximately equal to said bead height.

6. The connector according to claim 5, wherein said bead has a bead width measured parallel to said mating axis, and said groove has a groove width which is slightly larger than said bead width.

7. The connector according to claim 6, wherein said male mating area has a male mating area length measured in a direction parallel to said mating axis, and said female mating area has a female mating area length which is approximately equal to said male mating area length.

8. The connector according to claim 7, wherein said male mating area has an end facing said at least one contact receptacle, said fluid seal is located substantially away from said end.

9. The connector according to claim 8, wherein said male mating area includes a first region located between said fluid seal and said end and a second region located on the opposite side of said fluid seal; said first region having a first region length measured in a direction parallel to said mating axis, and said second region has a second region length measured in a direction parallel to said mating axis that is less than half of said first region length.

10. The connector according to claim 9, wherein said bead width is approximately 1½ times the bead height.

11. The connector according to claim 10, wherein the first region length is approximately four times the bead width.

12. The connector according to claim 11, wherein said groove width is approximately twice the length of said groove depth.

13. The connector according to claim 1, wherein said cylindrically shaped member has a dome-shaped end.

14. The connector according to claim 13, wherein said cylindrically shaped member has an hourglass shape having a middle diameter and two end outer diameters.

15. The connector according to claim 14, wherein said latch contains an opening slightly larger than said middle diameter and slightly larger that said dome-shaped end.

16. The connector according to claim 15, wherein said cylindrically shaped member is made of a malleable material allowing said dome-shaped end to pressed through said latch opening.

* * * * *